United States Patent [19]

Lofton

[11] Patent Number: 4,712,333

[45] Date of Patent: Dec. 15, 1987

[54] TUMBLING MEDIA

[75] Inventor: Hugh P. Lofton, Long Beach, Calif.

[73] Assignee: Huck Manufacturing Company, Southfield, Mich.

[21] Appl. No.: 821,724

[22] Filed: Jan. 23, 1986

[51] Int. Cl.[4] ..... B24B 31/14

[52] U.S. Cl. ..... 51/164.5; 264/275; 241/184

[58] Field of Search ..... 51/164.5; 241/184; 264/278, 275

[56] References Cited

U.S. PATENT DOCUMENTS

| | | | |
|---|---|---|---|
| 2,328,998 | 9/1943 | Radford | 51/164.5 |
| 2,518,758 | 8/1950 | Cook | 241/184 |
| 2,653,769 | 9/1953 | Hall | 241/184 |
| 3,034,735 | 5/1962 | Cadwell | 241/184 |
| 3,426,121 | 2/1969 | Faulkner | 264/275 |
| 3,453,782 | 7/1969 | Hageluken et al. | 51/164.5 |
| 3,965,234 | 6/1976 | Lane, Jr. | 264/278 |
| 4,381,908 | 5/1983 | Roth | 264/278 |
| 4,396,192 | 8/1983 | Fitzpatrick | 264/275 |
| 4,436,276 | 3/1984 | Donahue | 264/275 |

FOREIGN PATENT DOCUMENTS

| | | | |
|---|---|---|---|
| 178662 | 11/1982 | Japan | 51/164.5 |

*Primary Examiner*—Harold D. Whitehead
*Attorney, Agent, or Firm*—Lawrence J. Shurupoff; Robert F. Hess

[57] ABSTRACT

A tumbling media element for use in tumbling non-magnetic workpieces includes a body portion formed of a non-magnetic material and a magnetic insert disposed within the body portion. The insert renders the body portion suitable for magnetic sorting techniques and may increase the total mass of the media element thereby generating greater kinetic energy during tumbling operations.

11 Claims, 7 Drawing Figures

TUMBLING MEDIA

BACKGROUND OF THE INVENTION

1. Field Of The Invention

This invention generally concerns tumbling media for use in tumbling non-magnetic parts, and more particularly relates to adapting a non-magnetic tumbling element with a ferro-magnetic insert to facilitate the separation and removal of the media from the work via magnetic separation.

2. Description Of Prior Developments

Tumbling media has long been used to clean, polish, debur or abrade various workpieces following such work forming operations as casting, molding, stamping, machining, etc. The media is typically loaded into a rotary drum or tumbler barrel such as described in U.S. Pat. No. 3,623,706 along with the workpieces whereby rotation of the drum causes the media to mix with and impact the workpieces. This mixing and tumbling action effects a gradual cleaning or abrading action over the surfaces of the workpieces.

After the workpieces have been adequately processed in the tumbler, they must then be separated from the tumbling media. Conventional sorting techniques including mechanical sifting and magnetic sorting have been used with generally adequate results in those instances when such methods may be efficiently employed. However, mechanical sifting with the aid of a sieve or screen is usually limited to those cases where there is a significant difference between the size of the workpiece and the size of tumbling media elements. Moreover, magnetic sorting is generally limited to those cases where either the workpiece or the media is magnetic so that magnetic attraction of either the workpiece or the media will effect separation and sorting.

A separation problem arises where the tumbling media and the workpieces are both non-magnetic and poorly suited to mechanical separation techniques such as sifting. For example, plastic, ceramic or rock-like tumbling media are frequently used to polish various non-magnetic metallic parts formed from materials such as brass and aluminum. In this case, sorting by hand has been required.

Hand sorting the media from the workpieces is a labor intensive process and brings with it most drawbacks associated with manual operations including increased cost and reduced output. Hand sorting is further complicated when the workpieces are of an awkward shape and requiring significant manipulation.

Another problem arises when a lightweight tumbling media such as a plastic media is used to polish a workpiece. Because of its relatively small mass, lightweight tumbling media does not develop adequate kinetic energy during tumbling to impact the workpieces with sufficient impulse to rapidly abrade or polish the workpiece surfaces. This usually requires a protracted tumbling operation to allow sufficient time for the media to slowly complete the tumbling process.

Accordingly, a need exists for a tumbling media which may be quickly and easily separated from a batch of non-magnetic workpieces by a magnetic separation process. A need also exists for a tumbling media having a non-magnetic impact surface for use in tumbling non-magnetic parts and which is adapted for magnetic separation techniques. Finally, a need exists for increasing the kinetic energy of lightweight tumbling media i.e. non-magnetic tumbling media in order to achieve a more rapid tumbling process.

SUMMARY OF THE INVENTION

The present invention negates the prior art need to manually separate non-magnetic tumbling media from non-magnetic workpieces by adapting the tumbling media with a magnetic insert so as to render the media suitable for magnetic separation. In addition, the magnetic insert usually increases the total weight of each media element, so that the kinetic energy of each element is increased during tumbling, thereby shortening the tumbling process.

Accordingly, it is an ojbect of this invention to provide a non-magnetic tumbling media element with a magnetic insert to adapt the media element for magnetic separation.

Another object is to increase the mass of a non-magnetic tumbling media element with a magnetically permeable insert in order to reduce tumbling time.

Still another object is to provide a method and apparatus for centering a magnetic insert within a tumbling media element prior to molding such element.

The realization of these objects and various other objects, features and attendant advantages of the present invention will be more fully appreciated from the following detailed description when considered in connection with the accompanying drawings, in which the same reference numbers designate the same or corresponding parts throughout.

BRIEF DESCRIPTION OF THE DRAWINGS

In brief the drawings of the subject invention include.

DETAILED DESCRIPTION OF THE PREFERRED EMBODIMENTS

Figure 1:
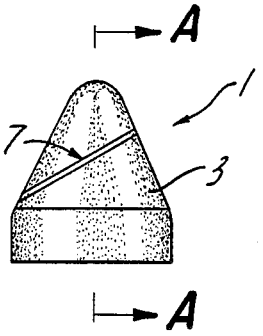
FIG. 1, a front elevation view of a tumbling element.
Figure 2:
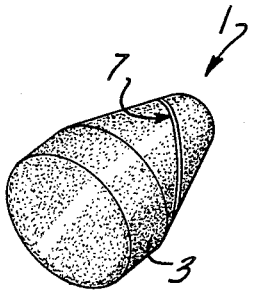
FIG. 2, a perspective view of the tumbling element of FIG. 1.
Figure 3:
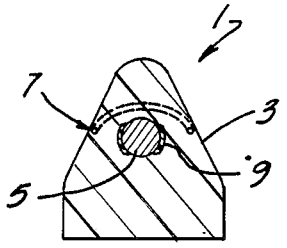
FIG. 3, a sectional view of the tumbling element taken along lines A—A of FIG. 1.

The tumbling media developed in accordance with the present invention will initially be described in conjunction with the accompanying FIGS. 1, 2 and 3 within which, for example, it is seen that the tumbling element 1 includes a body portion 3 formed of a non-magnetic material such as glass, ceramic, plastic or rock. Body 3 is shown as having a generally conical shape, however, any known geometric shape may be used such as conventional pyrimid, wedge, arrowhead, sphere or cylindrical shaped bodies in order to suit the media configuration to a particular tumbling application.

As shown in FIG. 3, the tumbling element 1 is provided with a magnetic ball shaped insert 5 to adapt the element for magnetic separation. Any ferro-magnetic material may be used to form the insert 5, although iron and steel compositions are preferred. Magnetic materials suitable for insert 5 include both magnetized materials and materials capable of being magnetized.

While a magnetic or magnetically permeable material is generally preferred, a magnetized material may not be preferred as mutual magnetic attraction between the tumbling elements could adversely affect the tumbling process. By encapsulating or surrounding the insert 5 within a non-magnetic body 3, the abrasive or polishing qualities of such non-magnetic material may be utilized while providing for magnetic separation of the media and non-magnetic workpieces after tumbling has been completed.

Since the insert 5 is usually of a greater density than the body portion 3, the overall weight and mass of the tumbling media is increased compared to a tumbling element without such an insert. The increased mass and weight generate greater kinetic energy during tumbling and result in an increased abrasive action. The tumbling element will impact the workpieces with greater force and will reduce the time necessary to complete tumbling.

It is preferred to locate the insert 5 proximate to the centroid or center of mass of the body 3. This particular disposition acheives a preferred tumbling and abrasive action between the media and workpieces and makes the media easier to handle. If the center of mass of the insert 5 is sufficiently displaced from the center of mass of the body 3, an erratic tumbling action will result which yields an unpredictable abrasive action. This result is generally considered undesirable from a quality control viewpoint.

Figure 4:
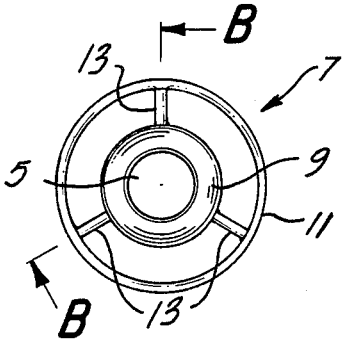
FIG. 4, a top plan view of a positioning member.
Figure 5:
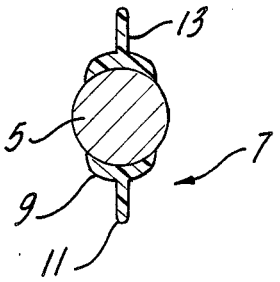
FIG. 5, a sectional view of a positioning element taken along lines B—B of FIG. 4.

As best shown in FIGS. 4 and 5, in order to align the center of the mass of the insert 5 as closely as possible in coincidence with the center of mass of the body 3, a positioning member 7 may be permanently fitted to the insert.

Positioning member 7 may be injection molded around the insert or may be molded and the insert subsequently snap-fitted therein or attached in any other manner such as by gluing. While a spherical insert 5 is shown for the purpose of illustration, the insert may be formed of any shape or size to suit its intended use.

Figure 6:
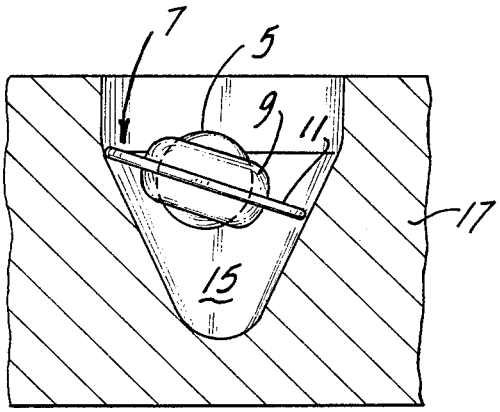
FIG. 6, a sectional view through a mold showing the relative positioning of an insert within a mold cavity prior to pouring of the media body therein.
Figure 7:
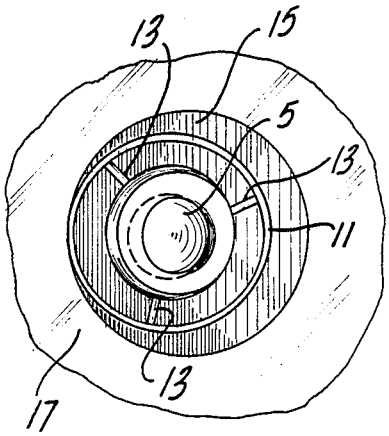
FIG. 7, a top plan view of the mold of FIG. 6.

Positioning member 7 is preferably formed of a plastic material. Body 3 is also preferably a matrix of plastic and may, and preferably will, include various abrasive particles, such as silicas, ceramics, alumina oxides and the like, disposed therein as a homogeneous mix therewith. Such a preferred material has the attributes of deburring and polishing both non-magnetic and magnetic materials. Member 7 includes insert engaging portion 9 connected to a mold engaging portion 11 via spoke members 13. As seen in FIGS. 6 and 7, the mold engaging portion 11, shown as a hoop, is dimensioned so that it will center the insert 5 within mold cavity 15 of mold 17 such that the center of mass of the insert 5 is positioned approximately coincident with the centeroid of the cavity. In this manner, the insert will be correspondingly centered thereat embedded within thereat said body member 3 after the mold cavity has been filled with a suitable body material and the material has hardened around the insert.

In thereat the preferred embodiment, the body 3, insert 5 and positioning element 7 are exactly as shown in FIGS. 1–4. A very satisfactory tumbling media for cleaning small titanium products such as shown and described in U.S. Pat. No. 4,472,096, assigned to the assignee of the subject invention, namely a titanium lockbolt type fastener for use in aircraft construction, is one having the following characteristics:

(1) a steel insert 5 having a diameter of about 5/16 inch to ⅜ inch,
(2) a combined weight of about 1 ounce,
(3) the relative size of the insert 5 to the body 3 being in the order of a ratio of 2:1 and thus providing an acceptable density ratio of about 20:1, and
(4) the body 3 being a plastic matrix having ceramic particles homogeneously mixed therewith.

Relative size of the insert is fairly unimportant provided it does not exceed about 75% of the volume of the body 3. The preferred density ratio of about 20:1 may be varied anywhere within the range of 10:1 to 30:1 with acceptable results.

It should be noted that it is not necessary to limit the composition of insert 5 to magnetic materials in order to achieve improved abrasive action through increased mass and kinetic tumbling energy. If magnetic parts are being tumbled it may be desirable to provide for subsequent magnetic separation by using a totally non-magnetic, magnetically impermeable media such as discussed above but provided with a non-magnetic or magnetically impermeable insert. Such an insert should nevertheless have a density greater than that of its surrounding member to increase the overall mass of each tumbling element. Lead or glass inserts may be used in this case.

Obviously, numerous modifications and variations of the present invention are possible in light of the above teachings. It is therefore to be understood that within the scope of the appended claims, the invention may be practiced otherwise than as specifically described herein.

What is claimed is:

1. A tumbling media element for polishing or abrading workpieces, comprising:

a non-magnetic, abrasive body member molded of a first material having a predetermined density;

an insert member molded within a matrix of said body member and formed of a second material having a density greater than said predetermined density of said body member for increasing the mass of said element; and a positioning and aligning member formed of a plastic material, said positioning and aligning member being permanently molded within said body member and molded around said insert member, said positioning and aligning member having a mold engaging portion for aligning said insert member within said body member during molding of said body member.

2. The element of claim 1, wherein said insert member is formed of a ferro-magnetic material.

3. The element of claim 1, wherein said insert member is disposed at the approximate center of said body member.

4. The element of claim 1, wherein said body member is formed of a plastic material.

5. The element of claim 4, wherein said plastic material has homogeneously mixed therewith a substantial number of abrasive particles for deburring and polishing products formed of various materials.

6. The element of claim 1, wherein said positioning member approximately centers said insert member within said body member.

7. The element of claim 1, wherein said body member is a solid body member.

8. The element of claim 1, wherein said mold engaging portion is formed as a hoop.

9. The element of claim 8, wherein said hoop is connected to said insert member via spoke members.

10. A tumbling media element for polishing or abrading workpieces, comprising:

a molded plastic body member having abrasive particles mixed therein;

a magnetic insert member molded within a central portion of said body member; and a plastic positioning and aligning member molded within said body member and having an insert engaging portion fitted around said insert member, said positioning and aligning member having a mold engaging portion extending from said insert engaging portion for aligning said insert member within said body member during molding of said body member.

11. The element of claim 10 wherein said insert member is snap fitted within said positioning and aligning member.

* * * * *